US010011033B2

(12) United States Patent
Stein

(10) Patent No.: US 10,011,033 B2
(45) Date of Patent: Jul. 3, 2018

(54) CUTTER FOR ADHESIVE AND OTHER TAPES

(71) Applicant: Peter Stein, Azur (IL)

(72) Inventor: Peter Stein, Azur (IL)

( * ) Notice: Subject to any disclaimer, the term of this patent is extended or adjusted under 35 U.S.C. 154(b) by 768 days.

(21) Appl. No.: 14/169,492

(22) Filed: Jan. 31, 2014

(65) Prior Publication Data

US 2014/0215837 A1 Aug. 7, 2014

(30) Foreign Application Priority Data

Feb. 2, 2013 (GB) ..... 1301881.7

(51) Int. Cl.
*B26F 1/32* (2006.01)
*B65H 35/00* (2006.01)
*B26F 3/00* (2006.01)

(52) U.S. Cl.
CPC ..... *B26F 1/32* (2013.01); *B65H 35/0026* (2013.01); *B26F 3/002* (2013.01); *B65H 35/008* (2013.01); *Y10T 225/257* (2015.04)

(58) Field of Classification Search
CPC ..... Y10T 225/257; Y10T 225/259; Y10T 225/295; Y10T 225/298; Y10T 225/299; B26F 1/32; B26F 3/002; B65H 35/0026; B65H 35/008
USPC ..... 30/358, 361, 366
See application file for complete search history.

(56) References Cited

U.S. PATENT DOCUMENTS 1,095,598 A * 5/1914 Roberts ..... B65D 83/0882 225/32
2,042,360 A * 5/1936 Riddle, Jr. ..... B65H 35/008 225/59
2,528,958 A * 11/1950 Johnson ..... B65H 35/008 225/26
2,560,394 A * 7/1951 Slezak ..... B65H 35/008 225/25
2,609,877 A * 9/1952 Hanington ..... B65H 35/008 225/25
2,734,575 A * 2/1956 Gilbreth et al. ... B65H 35/0026 225/56
3,295,735 A * 1/1967 Lincoln ..... B65H 35/002 225/52
3,348,524 A * 10/1967 Butler ..... B65H 35/0026 118/43
3,395,841 A * 8/1968 Brown ..... B65H 35/008 225/65
3,684,141 A * 8/1972 Hall ..... B65H 35/002 225/65
3,970,230 A * 7/1976 Horn ..... B26F 3/02 225/56
5,634,580 A * 6/1997 Levy ..... B65H 35/008 225/56
7,841,498 B1 * 11/2010 Rohrer ..... B65H 35/0026 225/56
2004/0188030 A1 * 9/2004 Chen ..... B65H 35/0026 156/510
2004/0232190 A1 * 11/2004 Chen ..... B65H 35/0026 225/61

(Continued)

*Primary Examiner* — Stephen Choi
*Assistant Examiner* — Evan MacFarlane

(57) ABSTRACT

Severing tools for adhesive and other tapes that are thin or are made from thin material and have one tip to allow their attachment to rolls of tape without substantially changing the outlook of the tape rolls and their production cost.

14 Claims, 4 Drawing Sheets

(56) References Cited

U.S. PATENT DOCUMENTS

2009/0158599 A1* 6/2009 Wu ..... B65H 35/0026
30/296.1

* cited by examiner

CUTTER FOR ADHESIVE AND OTHER TAPES

SUMMARY OF THE INVENTION

This invention relates to tools to break and cut adhesive and non-adhesive tapes.

BRIEF DESCRIPTION OF THE DRAWINGS

FIG. 9 shows four imaginary infinite extension lines of which each one having a segment including a different folding line or bend, and shows four additional infinite straight lines intersecting and extending through four different segments of which each one belonging to a different extension line such that each segment of an extension line including and extending between two ends of a folding line or bend has one of the additional infinite lines extending perpendicularly through the segment and intersecting any one segment of an extension line including and extending between two ends of a folding line or bend. FIG. 9 shows the first, second, third, fourth and fifth panels, in this order, starting from the right side of the rightmost bend. FIG. 9 shows the first, second, third and fourth folding lines or bends, in this order, starting from the left side of the of the first panel.

FIG. 12A is a frontal view of the rectangular and rightmost or first panel shown in FIGS. 3 and 9 completed with imaginary infinite lines.

FIG. 12B is the perspective view as in FIG. 5 of the second panel shown at the left side of the first panel in FIGS. 3 and 9 and in FIG. 12A.

FIG. 12C is the perspective view as in FIG. 5 of the third panel shown at the left of the second panel in FIGS. 3 and 9 and in FIG. 12B. The dotted area in FIG. 12D indicate an infinite plane and the dotted area in FIG. 12E indicate an infinite half plane, each defined by two infinite lines.

FIG. 12D includes portions and imaginary elements in frontal, back and perspective views. FIG. 12D includes a back view as in FIG. 5 of the folded fourth panel shown at the left of the third panel in FIGS. 3 and 9 and at the right of the third folding and extension lines shown in FIG. 12C. FIG. 12D includes a frontal view of the second extension line that includes the second folding line or bend shown in and such as in FIG. 5. FIG. 12D shows perspective view of an imaginary infinite line intersecting and perpendicular to the fourth plane and the segment including the third bend. FIG. 12D shows perspective view of an imaginary infinite line extending perpendicular to the fourth plane, to the second extension line and intersecting the second extension line to form an imaginary plane perpendicular to the fourth plane.

FIG. 12E is a perspective view as in FIG. 5 of the folded fifth panel shown at the left of the fourth panel in FIGS. 3 and 9 and at the left of the fourth folding and extension lines shown in FIG. 12D.

Figure 1:
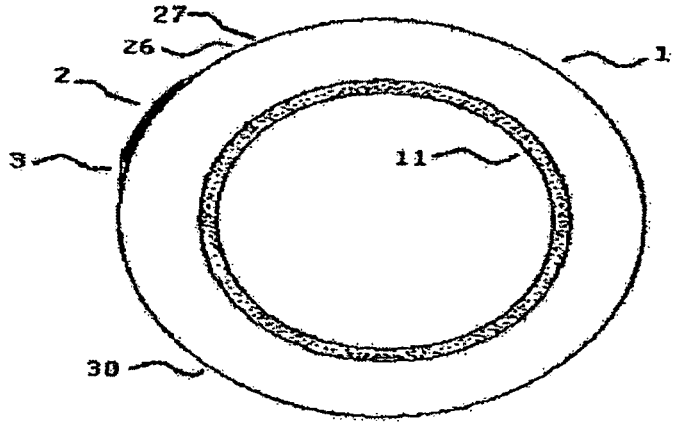
FIG. 1 is a side view of an adhesive or non-adhesive colorless and transparent tape rolled around a hollow core that has color and of an initial tape-start tag or sign placed between the first most outer layer of the tape roll and the second most outer layer of the tape roll.

It is assumed in the drawings that the prepared device is going to be kept in and used by one's right hand involving especially the thumb, the index or first finger, and the middle or second finger. Left hand use is symmetrical. The prepared device in the description has at least one bursting tip, and its usage may involve adherence means or adhesive means like any combination of glue, wetness, humidity, micro suction cups, cohesion of surfaces, magnets and other means. The tape bursting device can be made, for instance, by folding or axially bending a piece cut off from a strip or sheet that can be flexible or can be axially bendable and resilient so that it can be curved along or parallel with the curve of the roll of tape and which, after being folded and/or axially bent, will substantially retain the partially or entirely folded and/or axially bent shape and have sufficient firmness.

This specification discloses embodiments for tape burster and breaker that can be unfolded, removable initial tape-start tag or sign ready to be reused as tag and/or tape burster or be converted to a reusable tape-start tag or sign and/or tape burster by folding and/or axially bending it along the lines that are printed, impressed, imprinted, etched, ingrained, made by heat treatment, made by bending, shown on adhesive label and/or provided on or attached by other means to the initial tape-start tag or sign and/or by folding it according to separately attached, printed and/or provided instructions. The device can be used for glue-less wide cellophane tapes also, for instance. These devices are simple and can be safe, light, easy to carry and inexpensive to manufacture, package, attach.

DETAILED DESCRIPTION OF THE DRAWINGS

Figure 5:
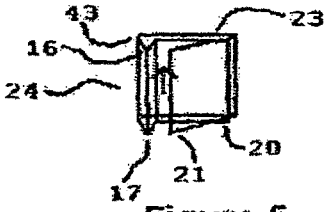
FIG. 5 is a perspective view of the prepared mostly colorless and transparent device that can be used as reusable tape-start sign, layer separator and tape burster.
Figure 6:
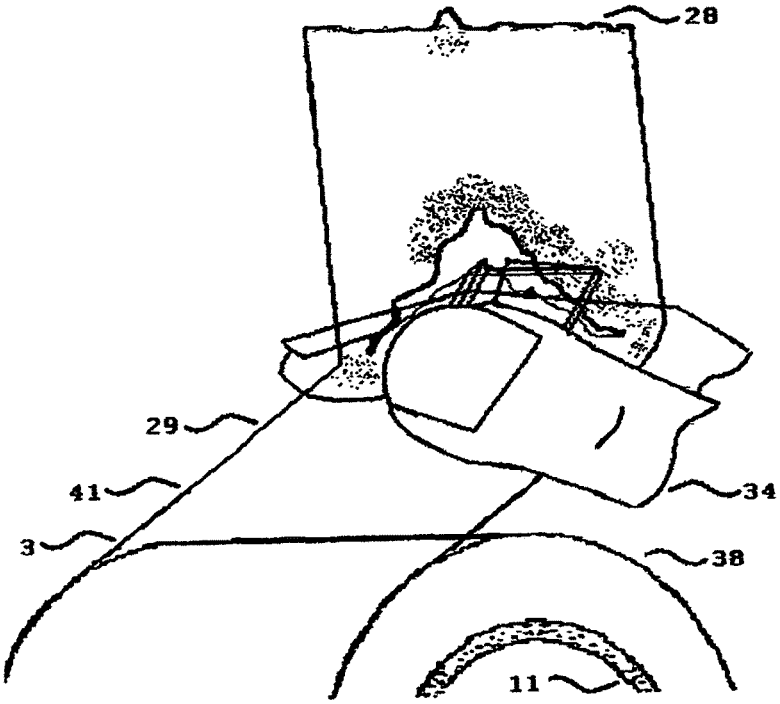
FIG. 6 is a perspective view of a partially shown roll of tape with core and partially unrolled and bursted transparent tape that can have the core of the roll pulled over the third and/or forth finger of the right hand of the user while the thumb and one of the index and middle fingers of the right hand of the user press and hold the unrolled portion of the tape between the device and the thumb and hold the device between the tape and one of the index and middle fingers. The tape is stretched by the thumb between the roll and the thumb and between the thumb and the boundary of the free end of the tape held by being stuck to a surface or by other means while the two tape sections substantially diverge. A portion of the frontal side of the tape bursting device of FIG. 5 is shown through the tape and the orifice created by, and widened after, bursting the tape in a position that is substantially paralleling the tape section extending between the roll and the thumb.
Figure 7:
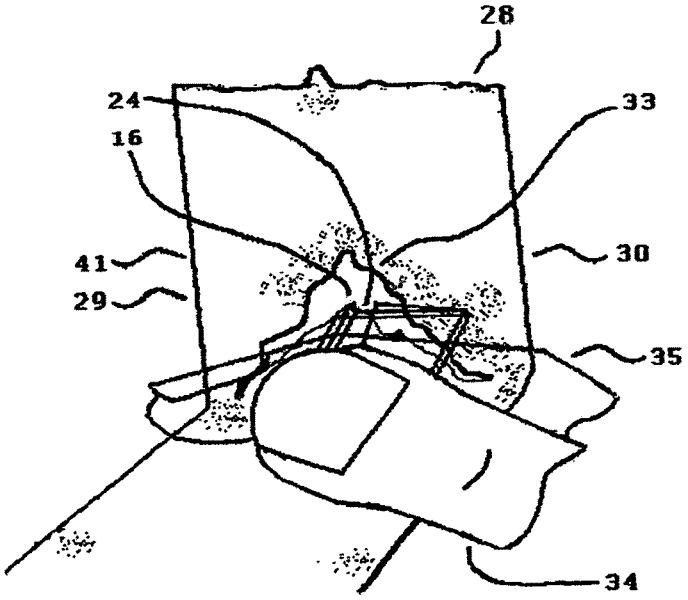
FIG. 7 is the partial perspective view of the partially unrolled and bursted transparent tape of FIG. 6 which excludes the core and the rolled-up portion of the tape while the thumb and one of the index and middle fingers of the right hand of the user press and hold the tape between the device and the thumb and hold the device between the tape and one of the index and middle fingers while additionally the thumb, finger and bursting device are kept in contact with the tape.
Figure 8:
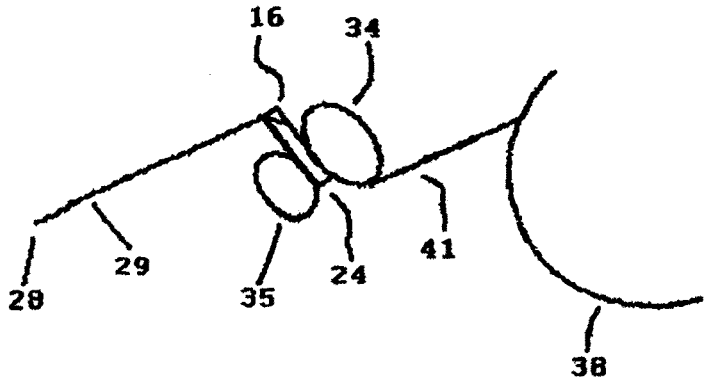
FIG. 8 is a simplified side view of the partially shown roll of tape, kept in right hand, having an unrolled portion of tape kept between thumb and the bursting device and between thumb and one of the index and middle fingers while the bursting device is between tape and one of the index and middle fingers and the bursting tip of the device is shown bursting the tape. Only the tips of the thumb and of one of the index and middle fingers are shown.
Figure 10:
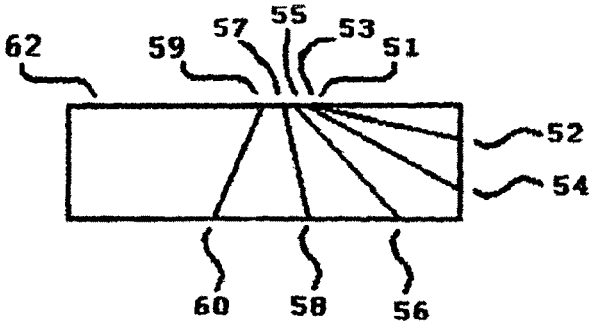
FIG. 10 is a frontal view of a partially or entirely transparent initial tape-start tag or sign that carries lines indicating where to fold the tag to convert it to a reusable tape-start sign and tape burster.

In the description the tape 1 in FIG. 1 and tape 38 in FIGS. 6 and 8 can be adhesive tape or non-adhesive tape. If the tape 1 or 38 is not adhesive then the tape bursting device 24 in FIG. 5 and device 63 in FIG. 11 could have means to be reusably and removably adhered to the tape. The foldable and/or axially bendable piece of strip or sheet 2 in FIGS. 3 and 4, 37 in FIGS. 2 and 62 in FIG. 10 can be separated from the tape before it is folded and/or axially bent properly to provide a tape bursting and breaking device 24 in FIGS. 5, 6 and 7 or device 63 in FIG. 11 and the device can be reused as tape burster on both sides of an adhesive tape, and it may be used from an adhesive side of the tape by which the sticking of the device to the tape would necessarily precede the tape bursting and breaking action and thus could not be skipped, so sticking the device 24 and/or 63 to and bursting the tape with it can ensure a device that is adhered to the start of the tape 1 and/or 38 in FIGS. 6 and 8 and is easily findable on and separable from the tape 1 and/or 38. In a new tape roll 1 the unfolded or non-assembled and flattened or flat device component 2, 37 and/or 62 could replace or follow a tag or sign of start of tape. In a roll of wide packaging tape 1 the device component 2, 37 and/or 62 could replace the initial tape-start tag or sign since it may have similar length and width but a greater thickness, which could be 0.4 mm for instance, if it is made from flexible or axially bendable and resilient strip or sheet like those used in blisters for packages. Such a device component piece would be flexible and could need no or minimal changes in the production process of tape rolls and it could be marked with lines indicating where to fold the piece of strip 2 and/or 62 to easily make a tape bursting and breaking device 24 and/or 63 respectively. The non-assembled source piece 2 of the device 24 and/or 62 of device 63 may also carry printed material and/or drawings like instructions, the arrow 22 in FIGS. 3 and 4 and/or images about the relative and proximal place of the start 26 of the tape 1 that is situated before the end portion 27 of the first most outer layer of the tape roll 1 in the indicated direction. Directions for use could be printed on the inside of or on the hollow core 11 around which the tape of roll 1 is rolled up.

In a roll of tape 1 the flexible and/or axially bendable and resilient piece 2, 37 and/or 62, that is convertible to tape burster 24 and/or 63 which may be also a reusable tape-start sign, could be longer and lay under a longer length of tape section when the tape is narrow or the design and usage purpose of the tape burster would need a source piece having a larger area that may carry marks and info and could be partially cut to be bent and/or folded by following the instructions.

Figure 3:
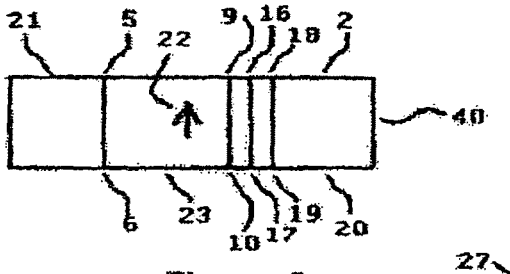
FIG. 3 is a frontal view of a mostly colorless and entirely or partially transparent initial tapestart tag or sign that carries an visible arrow pointing toward the proximal outer end of the tape and the end portion of the first most outer layer of the tape roll and carries visible lines indicating where to fold and/or axially bend the tag to convert it to a reusable tape-start sign, layer separator and/or tape burster.

To fold a flat piece of sheet 2 in FIG. 3 to convert it to a device 24 that can burst the tape 1 and/or 38 and which may be used also as sign of start of tape 1 and/or 38 when the tape has at least one side covered, at least partially, by adhesive means and/or the assembled device 24 has a side or the side with the bursting tip 16 covered by adhesive means that may be reusable, the two adjacent areas delimited by the three subsequent line segments—extending between their extreme points 9 and 10, 16 and 17, 18 and 19 respectively—have to be axially bent along the middle line segment between extremes 16 and 17 so that they form a shape having a narrow-enough V-form profile or a triangle with a missing base opposite to tip 16 in FIG. 5 and so the two subsequent portions of the piece form a narrow hollow wedge having a relatively long edge extending between extremes 16 and 17 in FIG. 5. By axially bending the piece 2 in FIG. 3 along the lines extending between their extreme points 5 and 6, 9 and 10, 16 and 17, 18 and 19 as shown in FIG. 5 the hollow V-profile wedge shape formed by the two portions on the two sides of the edge between extremes 16 and 17 will practically become a construction that is stable and firm enough during its holding in hand and usage for tape bursting and breaking. The piece 2 will be axially bent along the leftmost line between extremes 5 and 6 and the leftmost portion 21 will be axially bent over the rightmost boundary 40 of the piece 2 to keep the construction stable and firm. By axially bending the piece along the two leftmost lines between extremes 5 and 6, 9 and 10 as shown in FIG. 5 the portion 23 delimited by the two leftmost bars between 5 and 6, 9 and 10 in FIG. 3 will lay parallel and will double the rightmost portion 20 of the piece 2 while the two strips adjacent to edge between extremes 16 and 17 of the "V"-profile shape stay practically equally steeply tilted relative to and protruding from the board 43 of the portions 23 and 20 of the device 24.

When device 24 is used as a tape burster and before the unrolled tape 41 is bursted and partially broken as shown in FIGS. 6 and 7 and in simplified side view of FIG. 8, the device 24 in FIG. 5 can be held pressed to the back side of the unrolled transparent tape 41 in FIG. 7 extending between its boundaries 29 and 30 while tape 41 and device 24 are kept between the thumb 34 and one of the the second and first fingers 35 in such a position that the edge line between extremes 16 and 17 on top of the protruding "V" profile construction touches the back side of the stretched tape 41 and is parallel to or slightly tilted relative to the boundary lines 29 and 30 and is at sufficient distance or at roughly equal distance from the boundaries 29 and 30. Right before bursting the tape 41 it happens that the tape 41, device 24, edge between extremes 16 and 17, and/or portion 20 and/or portion 21 are pressed together in between the thumb 34 and the second or first finger 35 of the right hand of the user, and these two fingers 34 and 35 are placed at distance from the protruding tape-bursting corner and/or tip 16 of the device 24, and the thumb 34 placed on and pressing the portion of tape 41 that is on the axial bending edge between extremes 16 and 17 and/or thumb 34 is on the larger axially bent area 21 of the device 24 and the second or first finger 35 is placed on the back side 23 and pressing the device 24 on the base of the "V"-profile construction opposite to its axial bending line between extremes 16 and 17. If at least one side of the tape 41 is having adhesive means then the device 24 can be placed and stuck to the tape 41 before starting the bursting and breaking of the tape 41. Thereafter the tape 41 can be stretched and the tape 41 and/or the device 24 can be rotated so that the upper protruding corner or tip 16 of the device 24 can be preferably briskly pulled against the adhesive back side of the stretched tape 41 to collide with the tip 16 when the thumb 34 and finger 35 so hold the edge between extremes 16 and 17 that it is totally or almost included in a plane that is simultaneously perpendicular to the surface of the stretched tape 41, and to the portion of back side 23 that is not behind portion 20 of the device 24 in FIGS. 5, 6, 7 and parallel to tape boundaries 29 and 30. Such a collision can burst the tape 41 at the contact point with tip 16 in FIG. 8 along a widening short line 33 in FIG. 7.

After the device 24 and the upper tip 16 of its construction having the "V" profile burst the tape 41 the device 24 and the portion of the tape 41 that is kept between the fingers 34 and 35 can be aligned to substantially parallel or be in the same plane as the tape portion 41 that is stretched between the thumb and tape end 28 and to be in its continuation before being pulled by fingers 34 and 35 to completely break the tape 41, or alternatively to be pushed by the thumb 34 to stretch the tape 41 and be managed to rotate relative to the tape 41 in a direction that is a contrary direction to the relative rotation made right before and during the bursting of the tape 41 until the edge between extremes 16 and 17 and portion 20 are facing toward the unrolled and free end 28 of the tape 41 and/or 26 of tape 1 after being unrolled ensuring the relatively most unimpeded peeling and breaking of the tape 41 off a part of the frontal surface including portion 21 of device 24 and off the finger 35. In the latter cases, by pulling the tape with thumb 34 and finger 35 and/or by pushing the tape 41 that is between the thumb 34 and the device 24 with the thumb 34 to stretch the portion of the tape 41 that extends between tape end 28 and the device 24, the tape 41 can be broken along a line that completes line 33 and is running across the tape roughly perpendicularly to both boundary lines 29 and 30 like the previous break line 28. The break line, that is created by continuing and completing the line 33, runs on device 24 and through or slightly under the bursting corner or tip 16 and under the upper boundary of the board 43 of the device 24. If the side of the tape 41 facing device 24 and tip 16 carries adhesive means and/or there is adhesive means between the two then the device 24 will stay stuck on that side after the tape 41 is broken and the break line will run roughly along the portions of the holding second or first finger 35 that touched the tape and slightly under the bursting corner or tip 16 of the device and under the upper boundary of board 43.

Using this kind of tape bursting and breaking devices and methods more kinds of tapes and adhesive tapes can be bursted and broken and could come with an inexpensive tape start sign that can be removed and converted to a reusable tape start sign and/or tape burster and breaker. When using this device 24 the breaking of the tape 41 may occur automatically after the bursting of the tape or by firmly keeping the tape 41 and pressing it to the device 24 while both are held between the thumb 34 and finger 35 and stretching the tape portion extending between the device 24 and the free end 28 of the unrolled tape portion 41 while the thumb 34 is pushing the tape 41 and the device 24 so that the tape is partly peeled off the device 24 and the holding finger 35 while the incomplete break line grows until the tape 41 is broken.

Figure 11:
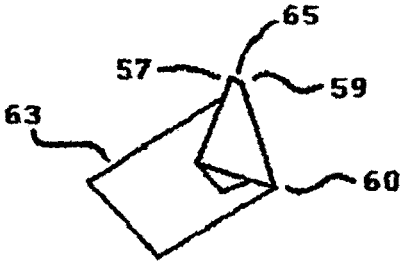
FIG. 11 is a simplified frontal view of the partially or entirely transparent device made by multiple folding from the piece shown in FIG. 10 that can be used as reusable tape-start sign and/or tape burster.

Some tapes may need a sturdier bursting device 63 like the one shown in FIG. 11 that is more suitable for easy reuse than a round conical shape having no folding lines and would unwind when not held tightly in hand and squeezed. The device 63 is made by multiple, spiraling and consecutive folding of the piece 62 shown in FIG. 10 along the lines extending between the extremes 51 and 52, 53 and 54, 55 and 56, 57 and 58, 59 and 60 in this order and in a unchanging rolling direction by ensuring that each folding is landing onto the frontal side of the subsequent portion of piece 62 and/or according to a separate instruction set. The device 63 in FIG. 11 is to be used like the device 24 shown in FIG. 5 with the second or first finger extending between the tape boundaries and behind the device while pressing it to the tape and the thumb and substantially contacting the tape, so that when the tip 65 starts bursting the tape it is touching the tape length that extends between the pressing finger and the free end of the tape and preferably the tape so touches and faces the device 63 that if the face of the tape carries adhesive means the stuck device 63 will keep the rolled-up form.

As part of the production process, a wide enough sheet roll around long cylinder core can be printed or get adhered to marks and info and be cut in strips parallel to the length of the core.

Alternatively, a sheet roll around a long cylindrical core can get impressed, printed, adhered to marks and/or info and/or other sign means and can be cut in tape rolls having disc-like shapes and narrow profiles that would get unrolled and flattened by counter rolling and/or by other means like heat treatment to enable a production sequence that is similar to those currently used for attaching initial tape-start and/or tape-separator tags or signs to tapes.

When the tape burster is also used as reusable tape-start sign which is stuck to the side and location of the tape where the tip 16 and/or 65 of the device got in touch with the tape, before it bursted the tape and stayed there after the tape was broken, the tape burster can be easily removed by folding the tape portion stuck to the tape bursting device backward such that it will be between the device and the other tape wing along the folding line and thus the burster tip and/or its vicinity can be pushed parallel to the folded and overlaying portions of the tape by which the tape gets peeled off the device and it can be held between the middle and index finger until it will be stuck to the tape and possibly reused for bursting and breaking the tape and/or as tape-start tag or sign.

Axially bending along any line on the source piece 2 can be easily started and/or done by placing the piece 2 on a dense and unrolled part of the most outer layer of the tape roll 1 and practically laying the line on piece 2 on one of and part of piece 2 between the two boundaries 29 and 30 before firmly pressing the part of piece 2 to the outer layer between boundaries 29 and 30 and perpendicularly pushing the outlying portion in the vicinity of and/or right in the center of the line on piece 2 toward the center of the circle in the nearest round end of the cylinder of core 11 and/or roll 1. The roll 1 can be used similarly for source piece 62.

Figure 2:
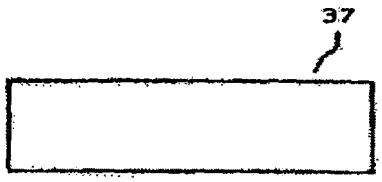
FIG. 2 is a frontal view of a colorless and transparent, thin, axially bendable and resilient initial tape-start tag or sign that can be converted to a reusable sign and tape burster by properly bending it.

The transparent and plain source piece 37 in FIG. 2 can indicate the exact or proximal location of the tape start by making the roll 1 to be protuberant where it lies above and/or under the most outer layer of the tape roll 1, and/or can be converted to tape burster with bare hands through the following steps: bending the piece 37 and align its ends then folding it in two to make a bending line in the middle of and perpendicular to the longer boundaries, axially bending again the folded piece parallel to and along a new line 2 to 4 mm far from the first bending line to form two overlaying and almost equal strips, forming a V-profile wedge with the two strips on two sides of the first bending line and aligning all bending lines and free shorter boundaries to be practically parallel, holding and pressing the remaining layers against each other, to keep the wedge shape unchanged, and axially bending them together, toward the side having the wedge, along a line that is 2 to 4 mm far from and parallel to the free shorter boundary on the opposite side. Before or after the first bending line on the plain and transparent piece 37 is made, the tape roll 1 can be used for parallel alignments and for starting and/or making practically straight bending lines in ways resembling the way described for piece 2. Roll 1 can be used also for axial bending along the lines of source piece 62.

Other embodiments of the invention, like a sturdy triangle having practically a straight line or curved line profile, can provide ready made reusable tags and/or tape bursters.

This kind of devices, unlike many dispensers, don't request that roll 1 and/or 38 to be round rolls and they could have other shapes like one having a narrow and/or flat rectangular profile for easy storing and carrying for instance.

Figure 4:
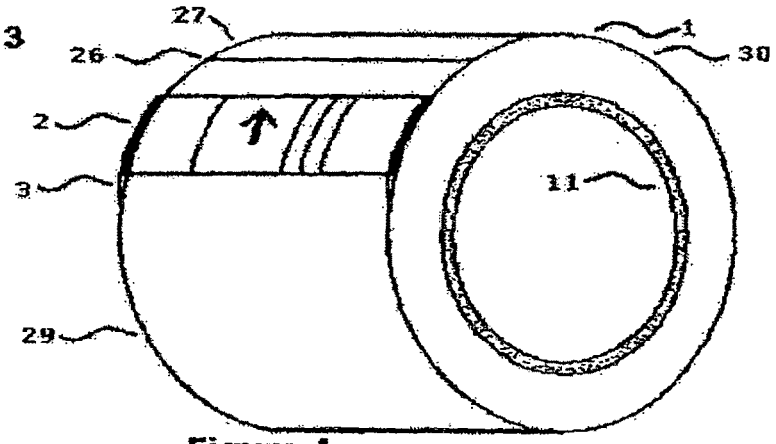
FIG. 4 is a perspective view of the colorless and transparent tape roll of FIG. 1 with a initial tape-start tag of FIG. 3.

In FIGS. 1 and 4 the initial tape-start tag, sign, or piece of strip or sheet 2 is placed between the first most outer layer 3 in of the tape roll and the second most outer layer of the tape roll. The foldable and/or axially bendable piece of strip or sheet 2 in FIGS. 1 and 4 is curved along or is parallel with the curve of the roll of tape.

The tape bursting device or tape separator can be made, for instance, by folding or axially bending a piece 2 cut off from a strip or sheet that can be flexible or can be axially bendable and resilient so that it can be curved along or parallel with the curve of the roll of tape as in FIGS. 1 and 4, and which after being folded and/or axially bent, will substantially retain the partially or entirely folded and/or axially bent shape and have sufficient firmness.

Using the formulations found in the claims and above, the fourth panel 23 having a straight borderline portion between extremes or ends 5 and 6 which is parallel with straight borderline portion and third folding line extending between ends 9 and 10;

the first folding line extends between the end 16 or top of a working tip and end 17, first panel 20 is between part of fourth panel 23 and fifth handle 21 and they form a secondary handle, fourth panel 23 is partially folded or axially bent relative to fifth panel 21, the borderline portion between ends 16 and 17 is bordering the second and third panels;

the two portions or panels on the two sides of the edge between extremes 16 and 17 will practically become a construction that is stable and firm enough during its holding in hand and usage for tape bursting and breaking, and the bursting involves cracking a hole in the tape, a sturdy triangle having practically a straight line or curved line profile can provide ready made reusable tape bursters working as provided in the brief description and the specification which may imply that the piece of strip or sheet 2 or usage agent before being converted to a three dimensional separator may be flexible and unlike the construction in FIG. 5, which is specified to include a construction that is stable and firm enough during its holding in hand and usage for tape bursting and breaking, may not be stable and firm enough to even crack a hole in the tape when its large side is paralleling and stuck to the larger surface of the stretched out tape between the finger 35 and tape end 28 or free tape borderline portion and the end 16 moving perpendicularly to the larger side of the piece of strip or sheet 2 or usage agent and against the larger surface of the stretched out tape;

the structure in FIG. 5 is firm enough to keep the top 16 of the working tip sufficiently fixed relative to the fourth panel 23 when in use to burst or crack a hole in the tape 1 or 38 with top 16 of the working tip;

the specification discloses embodiments for tape burster 24 and breaker or separator that can be unfolded or is convertible to a flat or flattened piece of strip or sheet 2 or usage agent, a device component piece or piece of strip or sheet 2 in FIG. 3 that could be flexible could be printed and/or carrying marks and/or impressed with lines indicating where to fold the usage agent or piece of strip 2 in FIGS. 3 and 5 like those used in blisters for packages to easily make a tape bursting and breaking device 24 or separator; the unrolled transparent tape 41 in FIG. 7 extending between its boundaries 29 and 30 or parallel straight tape borderline portions while tape 41 and device 24 or separator are kept between the thumb 34 and one of the second and first fingers 35, the tape 41 that is stretched out has a tape end 28 or free tape borderline portion;

the role played by second or middle finger 35 may be one of a rigid cylinder having an axis and a diameter of at least 16 mm being an average width of a middle finger of an adult.

Follow below descriptions in the language of the claims and usage of reference numbers shown in at least one of the FIGS. 5, 9, 12A, 12B, 12C, 12D and 12E, to reduce or avoid interferences between the lines of the drawings and of the references.

In FIGS. 9, 12A, 12B, 12C, 12D and 12E the interrupted lines have finite lengths, the continuous straight lines are imaginary infinite continuous straight lines, each joint length of interrupted and continuous lines have the finite length of the interrupted line, and each two imaginary infinite continuous lines being intersecting or parallel also show an imaginary infinite plane.

The three dimensional device 24 of FIG. 5, for initiating a breakage in a roll of tape, comprising a sheet of material 2 or device 24 in planar state 2 folded into a three dimensional configuration 24 comprising a first bend 90, a second bend 91, a third bend 92 and a fourth bend 96 extending between bend ends 18 and 19, 16 and 17, 9 and 10, and 5 and 6, respectively. The three dimensional device 24 comprising a first planar panel 20, a second planar panel, a third planar panel, a fourth planar panel 23, and a fifth planar panel 21 extending between boundary 40 and first bend 90, first bend 90 and second bend 91, second bend 91 and third bend 92, third bend 92 and fourth bend 96, and fourth bend 96 and boundary 97, respectively.

The device 24 being foldable into the three dimensional configuration 24 from a planar state 2.

Figure 9:
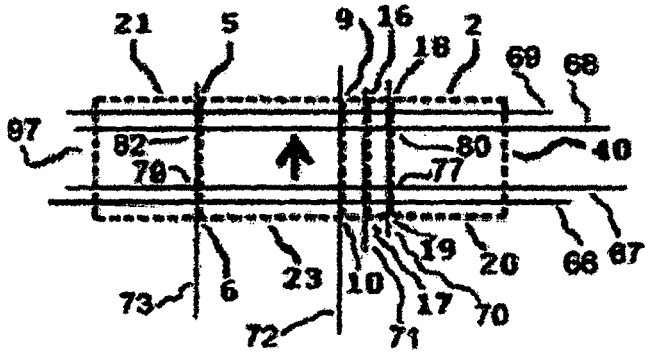
FIG. 9 is the frontal view of the tapestart tag or sign in planar state shown in FIG. 3 drawn with interrupted lines and completed with imaginary infinite continuous straight lines. In the claims, the tapestart tag is also referred to as sheet or device in planar state.

In FIG. 9 the imaginary infinite, continuous and straight extension lines 70, 71, 72 and 73 extend over and include the first 90, second 91, third 92 and fourth 96 bends, respectively, and define one infinite plane including sheet 2 or device 24 in planar state 2 and including extension lines 70, 71, 72 and 73.

In FIGS. 5, 12A, 12B, 12C, 12D and 12E boundary 40 and infinite extension line 70, line 70 and line 71, line 71 and line 72, line 72 and line 73, and line 73 and boundary 97 define the first imaginary infinite plane including first panel 20, second infinite plane including second panel, third infinite plane including third panel, fourth infinite plane including fourth panel 23 and fifth infinite plane including fifth panel 21, respectively. Bend ends 18 and 19, 17 and 16, 9 and 10, and 5 and 6 define an imaginary continuous segment of and within the first 70, second 71, third 72 and fourth 73 imaginary infinite extension line, respectively.

In FIGS. 9, 12A, 12B, 12C, 12D and 12E a first 66, second 67, third 68 and fourth 69 imaginary infinite line is perpendicular to the first 70, second 71, third 72 and fourth 73 extension line, respectively. The infinite line 66 forms intersection 74, 75 and 76 with the segment of the second 71, third 72 and fourth 73 extension line, respectively. Infinite line 67 forms intersection 77, 78 and 79 with segment of the first 70, third 72 and fourth 73 extension line, respectively. Infinite line 68 forms intersection 80, 81 and 82 with segment of the first 70, second 71 and fourth 73 extension line, respectively. Infinite line 69 forms intersection 83, 84 and 85 with segment of the first 70, second 71 and third 72 extension line, respectively. Intersection 74. 75, 76, 77, 78, 79, 80, 81, 82, 83, 84, 85 is the first, second, third, fourth, fifth, sixth, seventh, eighth, ninth, tenth, eleventh and twelfth intersection, respectively.

In FIGS. 5, 12A, 12B, 12C, 12D and 12E at least a portion of the fourth panel 23 and at least a portion of the fifth panel 21 at least partially sandwich at least a portion of the first panel 20, a portion of the first panel 20 adjacent to at least a portion of the fourth bend 96.

FIGS. 12A, 12B, 12C, 12D and 12E show perspective views of of portions of the three dimensional device 24 of FIG. 5 and imaginary infinite lines.

The perspective views of the portions in FIGS. 12A, 12B, 12C, 12D, 12E are in essence the same in FIG. 5.

Figure 12A:
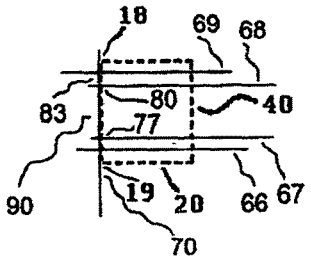
FIGS. 12A, 12B, 12C, 12D and 12E are frontal and perspective views of portions and imaginary infinite lines of the three dimensional device shown in FIG. 5. The views of the portions of the device of FIG. 5 shown in FIGS. 12A, 12B, 12C, 12D and 12E are the same as in FIG. 5.
Figure 12B:
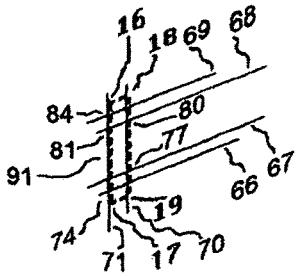
Figure 12C:
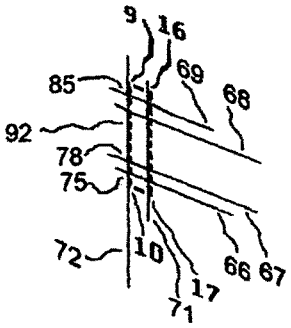
Figure 12D:
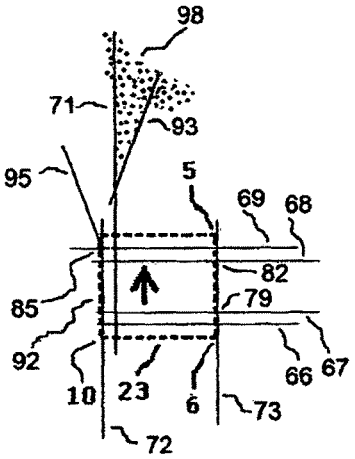
Figure 12E:
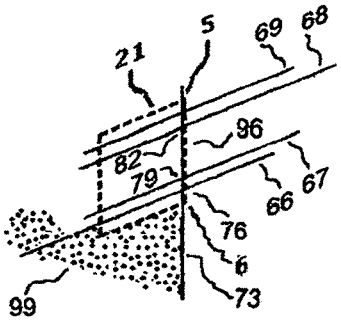

The dotted area in FIG. 12D indicate infinite plane 98 and the dotted area in FIG. 12E indicate infinite half plane 99.

FIG. 12D is a simplified three dimensional perspective view and shows frontal views of opposite face of fourth panel 23 relative to the face of fourth panel 23 shown in FIGS. 3 and 9, imaginary infinite lines 73, 66, 67, 68, 69 and imaginary second extension line 71. Imaginary extension line 71 and line 93 define an imaginary infinite plane 98. A simplified three dimensional perspective view of imaginary lines 93 and 95 in FIG. 12D is shown from an viewpoint being to the left of imaginary plane 98, proximal to lines 93 and 95 and on a same side of fourth plane including panel 23 relative to extension line 71.

Imaginary infinite extension line 71 including second bend 91 and fourth panel 23 have same relative positions in three dimensional perspective views of FIGS. 5 and 12D. In FIG. 12D imaginary infinite line 95 extends through the twelfth intersection 85 perpendicularly to fourth plane including panel 23. Imaginary infinite line 93 extending perpendicularly to extension line 71 and to the infinite fourth plane including panel 23. Imaginary extension line 71 and line 93 define an imaginary infinite plane 98 including the second extension line 71 and tip 16, and plane 98. The tip 16 on a same side of the fourth plane including fourth panel 23 relative to first panel 20.

In FIG. 12E an imaginary half plane 99 extending from and including imaginary fourth infinite extension line 73 extends through and includes fifth panel 21, and half plane 99. In the context of FIG. 5 imaginary line 95 in FIG. 12D and imaginary half plane 99 defined by and including fourth extension line 73 and fifth panel 21 intersecting on same side of fourth imaginary plane including panel 23 relative to tip 16.

The invention claimed is:

1. A device for initiating a breakage in a roll of tape, the device comprising:

a rectangular sheet of material folded into a three dimensional configuration, the three dimensional configuration comprising a first bend, a second bend, a third bend, a fourth bend, a first planar panel, a second planar panel, a third planar panel, a fourth planar panel, and a fifth planar panel;

the first panel having a first end and a second end opposite the first end, the first panel defining a first plane;

the second panel having a first end and a second end opposite the first end;

the first bend in the sheet of material extending linearly perpendicular to an edge of the sheet of material across an entire width of the sheet of material, the first bend defining a junction between the second end of the first panel and the first end of the second panel such that the second panel extends obliquely relative to the first panel;

the third panel having a first end and a second end opposite the first end;

the second bend in the sheet of material extending linearly perpendicular to the edge of the sheet of material across the entire width of the sheet of material, the second bend defining a junction between the second end of the second panel and the first end of the third panel such that the third panel extends at an angle from the second end of the second panel in a direction toward the first plane, wherein the third panel is obliquely angled relative to the first plane such that the second and third panels define a V-shape, the V-shape having a tip defined by the second bend, the tip spaced apart from the first plane;

the fourth panel having a first end and a second end opposite the first end;

the third bend in the sheet of material extending linearly perpendicular to the edge of the sheet of material across the entire width of the sheet of material, the third bend defining a junction between the second end of the third panel and the first end of the fourth panel such that the fourth panel extends obliquely relative to the third panel;

the fifth panel defining a first end and a second end opposite the first end;

the fourth bend in the sheet of material extending linearly perpendicular to the edge of the sheet of material across the entire width of the sheet of material, the fourth bend defining a junction between the second end of the fourth panel and the first end of the fifth panel, the fourth bend positioned adjacent to the first end of the first panel such that the fifth panel is on an opposite side of the first panel relative to the fourth panel;

wherein at least the fourth panel is configured to be gripped together with a portion of the tape by a user and the first, fourth and fifth panels define a portion of the device configured such that at least a portion of the fourth panel and at least a portion of the fifth panel at least partially sandwich at least a portion of the first panel, and wherein the device is configured to be gripped such that no portion of the device is between the tape and the tip of the V-shape, and the tip of the V-shape is configured to engage the tape to initiate the breakage;

the device can be used for initiating a breakage in a length of tape and also for initiating a breakage in a non-cylindrical roll of tape.

2. The device for initiating a breakage in a roll of tape of claim 1 wherein the second end of the fifth panel is closer to the fourth bend than the second bend is to the fourth bend.

3. The device for initiating a breakage in a roll of tape of claim 2 wherein the device is configured to simultaneously have the second, the third and a portion of the fourth panels define a hollow triangular prism, the second and the fourth panels define an angle having a size of at most a quarter of a circle inside the triangular prism, the third and the fourth panels define an angle having a size of at most a quarter of a circle inside the triangular prism, and the tip is configured to engage the tape to initiate the breakage.

4. The device for initiating a breakage in a roll of tape of claim 1 wherein the device is configured to simultaneously have the second, the third and a portion of the fourth panels define a hollow triangular prism, the second and the fourth panels define an angle having a size of at most a quarter of a circle inside the triangular prism, the third and the fourth panels define an angle having a size of at most a quarter of a circle inside the triangular prism, and the tip is configured to engage the tape to initiate the breakage.

5. The device for initiating a breakage in a roll of tape of claim 1 wherein the rectangular sheet of material is flexible.

6. The device for initiating a breakage in a roll of tape of claim 5 wherein the device is configured to simultaneously have the second, the third and a portion of the fourth panels define a hollow triangular prism, the second and the fourth panels define an angle having a size of at most a quarter of a circle inside the triangular prism, the third and the fourth panels define an angle having a size of at most a quarter of a circle inside the triangular prism, and the tip is configured to engage the tape to initiate the breakage.

7. The device for initiating a breakage in a roll of tape of claim 5 wherein the second end of the fifth panel is closer to the fourth bend than the second bend is to the fourth bend.

8. The device for initiating a breakage in a roll of tape of claim 7 wherein the device is configured to simultaneously have the second, the third and a portion of the fourth panels define a hollow triangular prism, the second and the fourth panels define an angle having a size of at most a quarter of a circle inside the triangular prism, the third and the fourth panels define an angle having a size of at most a quarter of a circle inside the triangular prism, and the tip is configured to engage the tape to initiate the breakage.

9. A device for initiating a breakage in a roll of tape, the device comprising:

a sheet of material folded into a three dimensional configuration, the three dimensional configuration comprising a first bend, a second bend, a third bend, a fourth bend, a first planar panel, a second planar panel, a third planar panel, a fourth planar panel, and a fifth planar panel;

the device being foldable into the three dimensional configuration from a planar state;

the first panel defining a first plane;

the second panel defining a second plane;

the third panel defining a third plane;

the fourth panel defining a fourth plane;

the fifth panel defining a fifth plane;

the first bend defining a first infinite straight extension line, the first bend and a segment of the first extension line extending to and over a first edge of the planar state of the device and to and over a second edge of the planar state of the device opposite the first edge;

the second bend defining a second infinite straight extension line, the second bend and a segment of the second extension line extending to and over the first edge of the planar state of the device and to and over the second edge of the planar state of the device opposite the first edge;

the third bend defining a third infinite straight extension line, the third bend and a segment of the third extension line extending to and over the first edge of the planar state of the device and to and over the second edge of the planar state of the device opposite the first edge;

the fourth bend defining a fourth infinite straight extension line, the fourth bend and a segment of the fourth extension line extending to and over the first edge of the planar state of the device and to and over the second edge of the planar state of the device opposite the first edge;

a first infinite straight line perpendicular to the segment of the first extension line in the planar state of the device intersecting the segment of the second, the segment of the third and the segment of the fourth extension lines in a first intersection, a second intersection, and a third intersection respectively in the planar state of the device;

a second infinite straight line perpendicular to the segment of the second extension line in the planar state of the device intersecting the segment of the first, the segment of the third and the segment of the fourth extension lines in a fourth intersection, a fifth intersection, and a sixth intersection respectively in the planar state of the device;

a third infinite straight line perpendicular to the segment of the third extension line in the planar state of the device intersecting the segment of the first, the segment of the second and the segment of the fourth extension lines in a seventh intersection, an eighth intersection, and a ninth intersection respectively in the planar state of the device;

a fourth infinite straight line perpendicular to the segment of the fourth extension line in the planar state of the device intersecting the segment of the first, the segment of the second and the segment of the third extension lines in a tenth intersection, an eleventh intersection, and a twelfth intersection respectively in the planar state of the device;

the segment of the first extension line being not perpendicular to and having no intersection with the segment of the second, the segment of the third and the segment of the fourth extension lines in the planar state of the device;

the segment of the second extension line being not perpendicular to and having no intersection with the segment of the third and the segment of the fourth extension lines in the planar state of the device;

the segment of the third extension line being not perpendicular to and having no intersection with the segment of the fourth extension line in the planar state of the device;

the first panel having a first end and a second end opposite the first end;

the second panel having a first end and a second end opposite the first end;

the third panel having a first end and a second end opposite the first end;

the fourth panel having a first end and a second end opposite the first end;

the fifth panel having a first end and a second end opposite the first end;

the first bend defining a junction between the second end of the first panel and the first end of the second panel such that the second panel and second plane extend obliquely relative to the first plane;

the second bend defining a junction between the second end of the second panel and the first end of the third panel such that the third panel and plane extend at an angle relative to the second plane from the second end of the second panel in a direction toward the first plane, wherein the third panel and plane are obliquely angled relative to the first plane;

the third bend defining a junction between the second end of the third panel and the first end of the fourth panel such that the fourth panel and plane extend obliquely relative to the third plane;

the fourth bend defining a junction between the second end of the fourth panel and the first end of the fifth panel, at least a portion of the fifth panel is on an opposite side of at least a portion of the first panel relative to at least a portion of the fourth panel;

wherein at least the fourth panel is configured to be gripped together with a portion of the tape by a user and the first, fourth and fifth panels define a portion of the device configured such that at least a portion of the fourth panel and at least a portion of the fifth panel at least partially sandwich at least a portion of the first panel;

wherein the first panel and the fourth bend define a portion of the device configured to simultaneously have a portion of the first panel adjacent to at least a portion of the fourth bend, an infinite plane including the second extension line and extending perpendicularly to the fourth plane include a tip, the tip on a same side of the fourth plane relative to the first panel, the fourth bend and the fifth plane define a half plane being a portion of the fifth plane on a same side of the fourth plane relative to the tip extending from the fourth infinite extension line through the fifth panel, the twelfth intersection and the fourth plane define an infinite line perpendicular to the fourth plane, the half plane of the fifth plane extending at most obliquely relative to the fourth plane, the half plane of the fifth plane and the line extending through the twelfth intersection perpendicularly to the fourth plane define an intersection on a same side of the fourth plane relative to the tip, a portion of the second bend on a same side of the fourth plane relative to the tip be spaced apart from the tip and spaced apart from the fourth plane, the tip spaced apart from the first plane and the fourth plane, the device being configured to be gripped such that no portion of the device is between the tip and the tape, and the tip engage the tape to initiate the breakage;

the device can be used for initiating a breakage in a length of tape and also for initiating a breakage in a non-cylindrical roll of tape.

10. The device for initiating a breakage in a roll of tape of claim 9 wherein the second extension line extends through the tip.

11. The device for initiating a breakage in a roll of tape of claim 10 wherein a first end of the second bend forms the tip.

12. The device for initiating a breakage in a roll of tape of claim 9 wherein the sheet of material is flexible.

13. The device for initiating a breakage in a roll of tape of claim 12 wherein the second extension line extends through the tip.

14. The device for initiating a breakage in a roll of tape of claim 13 wherein a first end of the second bend forms the tip.

* * * * *